US012735156B2

(12) United States Patent
Verma et al.

(10) Patent No.: US 12,735,156 B2
(45) Date of Patent: Sep. 15, 2026

(54) SPLASH ZONE INSPECTION ROBOT

(71) Applicant: Oceaneering International, Inc., Houston, TX (US)

(72) Inventors: Vikrant Verma, Panchkula (IN); Sanjay Dubey, Wagle Estate (IN); Ashish Negi, Village Gazipur (IN); Sheethal Sasidharan, Kerala State (IN); Rajeev Narayanan Vidyadharan, Kerala (IN); Sushant Khanna, DeraBassi (IN)

(73) Assignee: Oceaneering International, Inc., Houston, TX (US)

( * ) Notice: Subject to any disclaimer, the term of this patent is extended or adjusted under 35 U.S.C. 154(b) by 833 days.

(21) Appl. No.: 17/824,092

(22) Filed: May 25, 2022

(65) Prior Publication Data

US 2022/0380009 A1 Dec. 1, 2022

(30) Foreign Application Priority Data

May 25, 2021 (IN) ..... 202111023355

(51) Int. Cl.
*B63G 8/00* (2006.01)
*B63G 8/08* (2006.01)
*B63G 8/22* (2006.01)

(52) U.S. Cl.
CPC ..... *B63G 8/001* (2013.01); *B63G 8/08* (2013.01); *B63G 2008/007* (2013.01); *B63G 8/22* (2013.01)

(58) Field of Classification Search
CPC .... B63G 8/00; B63G 8/001; B63G 2008/002; B63G 2008/004; B63G 2008/005; B63G 2008/007; B63G 8/08; B63G 8/14; B63G 8/16; B63G 8/22; B63G 8/24; B63C 11/52; E21B 41/04
See application file for complete search history.

(56) References Cited

U.S. PATENT DOCUMENTS 3,163,221 A * 12/1964 Shatto, Jr. ..... E21B 41/04 166/368
3,166,123 A * 1/1965 Watkins ..... E21B 33/035 414/592
3,307,627 A * 3/1967 Shatto, Jr. ..... F16L 37/002 166/344

(Continued)

FOREIGN PATENT DOCUMENTS

GB 2210838 A * 6/1989 ..... B63C 11/40
WO WO-2012011871 A1 * 1/2012 ..... B63G 8/001

*Primary Examiner* — Ajay Vasudeva
(74) *Attorney, Agent, or Firm* — Maze IP Law, P.C.

(57) ABSTRACT

The invention relates to the field of special purpose robotic systems to conduct external functions such as cleaning, monitoring and inspection of structures such as tubular assets in a splash zone. The splash zone is defined as the section of a marine structure that is periodically in and out of water due to the action of waves or tides, usually falling within (+)10 m to (−)20 m water depth. In embodiments, splash zone inspection robot system 1 comprises station 300, submersible saddle 350, submersible robot 400, and subsea robot controller 308. A predetermined set of controllable clamps selectively secure submersible robot 400 to submersible saddle 350 or structure 2 and allow incremental traversal along submersible saddle 350 or structure 2.

13 Claims, 8 Drawing Sheets

(56) References Cited

U.S. PATENT DOCUMENTS

| | | | | |
|---|---|---|---|---|
| 4,010,619 | A * | 3/1977 | Hightower | D07B 1/147<br>174/113 C |
| 4,674,915 | A * | 6/1987 | Shatto, Jr. | B25J 5/00<br>248/205.8 |
| 4,721,055 | A * | 1/1988 | Pado | B63G 8/001<br>405/188 |
| 9,080,425 | B2 * | 7/2015 | Zediker | B63G 8/001 |
| 10,738,913 | B2 * | 8/2020 | Clunie | F16L 55/46 |

* cited by examiner

SPLASH ZONE INSPECTION ROBOT

RELATION TO OTHER APPLICATIONS

This application claims priority through India Provisional Application 202111023355 filed on May 25, 2021.

BACKGROUND

The claimed invention relates to the field of special purpose robotic systems to conduct external functions such as cleaning, monitoring and inspection of tubular assets in a splash zone. Inspection of assets such as tubular pipe sections with outer diameter range between 6" to 60" in a splash zone region offshore is usually considered challenging due to the risks involved in protecting the safety of personnel, assets, and the environment. The combined wave pounding and drifts, high current drags, obstructions in approach, and space constraints make an task such as inspection or cleaning challenging and cumbersome. Current tools have limitations in their ability to carry heavier nondestructive testing (NDT) payloads, including radiographic test apparatuses like a source bottle and a detector plate, which may be required for a fully quantitative assessment of an object and/or are reliant on many platform interface points, e.g., position of lifting points, power supply socket locations, and the like, in order to conduct the operation. Manual intervention that may be needed in many such tools also make them unsafe in harsh weather and rough seas, thereby limiting their operability and availability in the field. Some existing solutions require the close support of rope access technicians and are very intensive on manual efforts in handling, setting up, deployment, usage and retrieval of the tool causing high lead time and, more importantly, safety concerns.

FIGURES

Various figures are included herein which illustrate aspects of embodiments of the disclosed inventions.

FIGS. 1A and 1B (collectively referred to as FIG. 1) are illustrations of an exemplary submersible robot clamped to an exemplary submersible saddle;

DESCRIPTION OF EXEMPLARY EMBODIMENTS

As used herein, a "splash zone" is a section of a marine structure that is periodically in and out of water due to the action of waves or tides, usually falling within +10 meters to −20 meters water depth. As used herein, "structure" includes but is not limited to risers, caissons, jackets, and similar structures. As used herein, "robot" is a machine, controlled by a computer or programmable logics, which is capable of carrying out multiple sequences of operations automatically or semi-automatically with the help of onshore and offshore operators. It can include, but is not limited to, remotely operated vehicles ("ROV"), autonomous underwater vehicles ("AUV"), or the like.

Figure 1A:
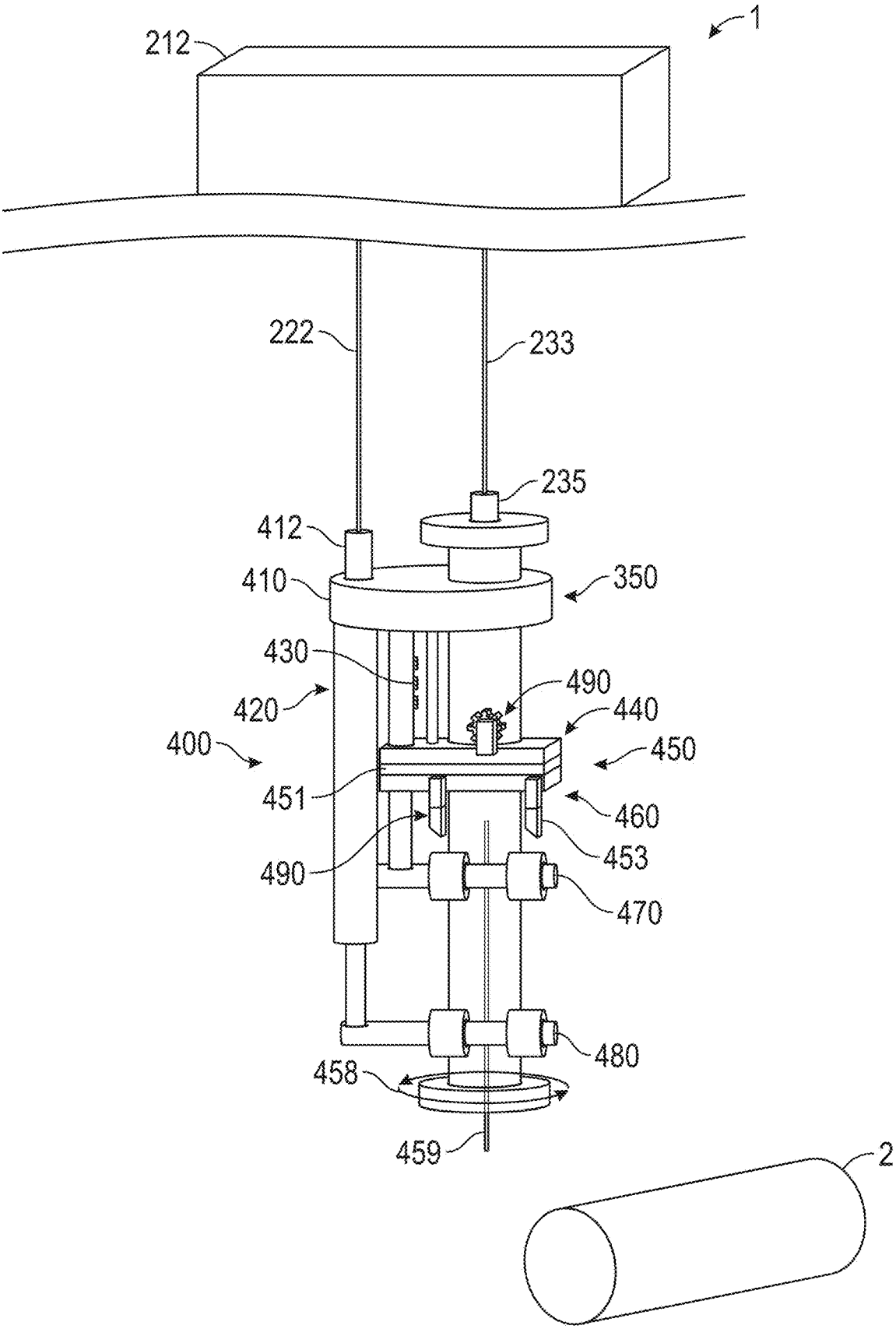
Figure 1B:
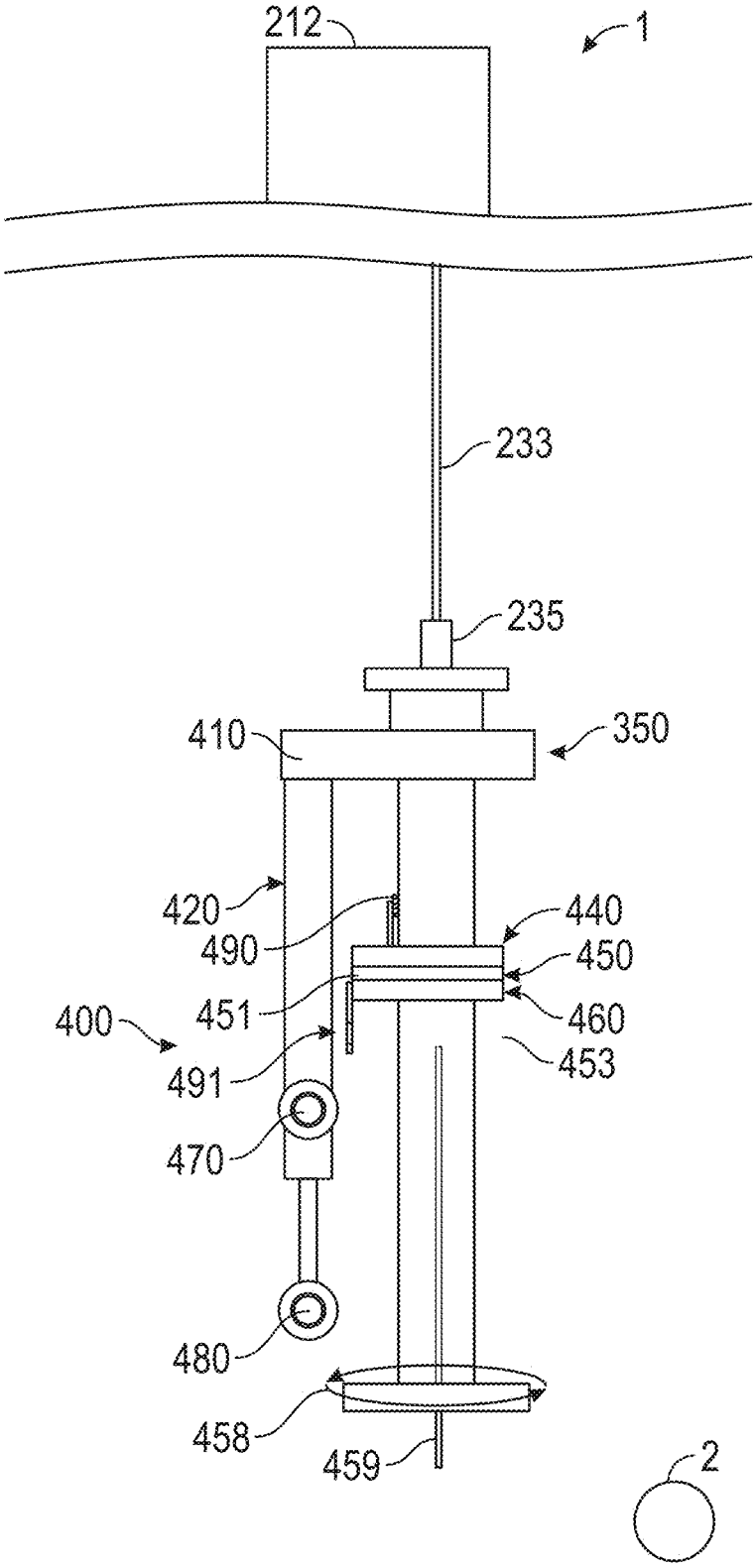

Referring now to FIG. 1, splash zone inspection robot system 1 comprises a robotic solution to mobility of inspection/cleaning tools, including, in embodiments, cameras, and lessens or removes manpower requirements, e.g., a team of rope access technicians, from these tools.

In embodiments, splash zone inspection robot system 1 can travel between structures 2 (only one such structure 2 is illustrated in FIG. 1) through water below a splash zone and is capable of moving itself on structures 2 using its multiple degrees of freedom abilities and controllable clamps 470, 480, eliminating a need to have multiple deployment points.

In an embodiments, splash zone inspection robot system 1 comprises station 300 (FIG. 2); submersible saddle 350 operatively connected to steel rope 233, e.g., at steel rope connector 235; submersible robot 400 operatively in communication with station 300, power distribution unit 200 (FIG. 3), and umbilical 222; subsea umbilical termination assembly S-UTA, which is typically part of submersible robot 400, where umbilical 222 is operatively connected to, and configured to terminate at, S-UTA 412 and where S-UTA 412 is operatively connected to one or more cranes or winches 212 which is operatively connected to submersible saddle 350; and subsea robot controller 308 (FIG. 2) operatively in communication with the submersible robot 400 where subsea robot controller 308 typically uses a microservice based software architecture for tool control. It is noted that splash zone inspection robot system 1 itself may only comprise submersible robot 400; subsea umbilical termination assembly S-UTA 412; and subsea robot controller 308 (FIG. 2) operatively in communication with the submersible robot 400. It is also noted that although illustrated as being part of or otherwise associated with station 300, subsea robot controller 308 may be internal to or otherwise associated with submersible robot 400.

Figure 2:
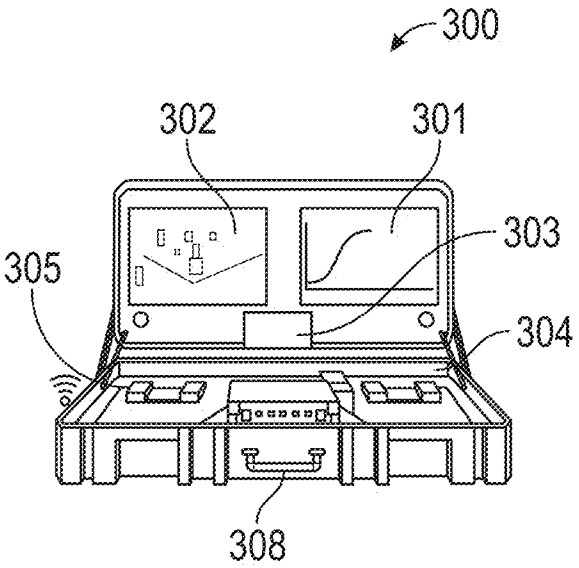
FIG. 2 is a schematic view of a Station showing a control van desk and briefcase embodiments.
Figure 2:
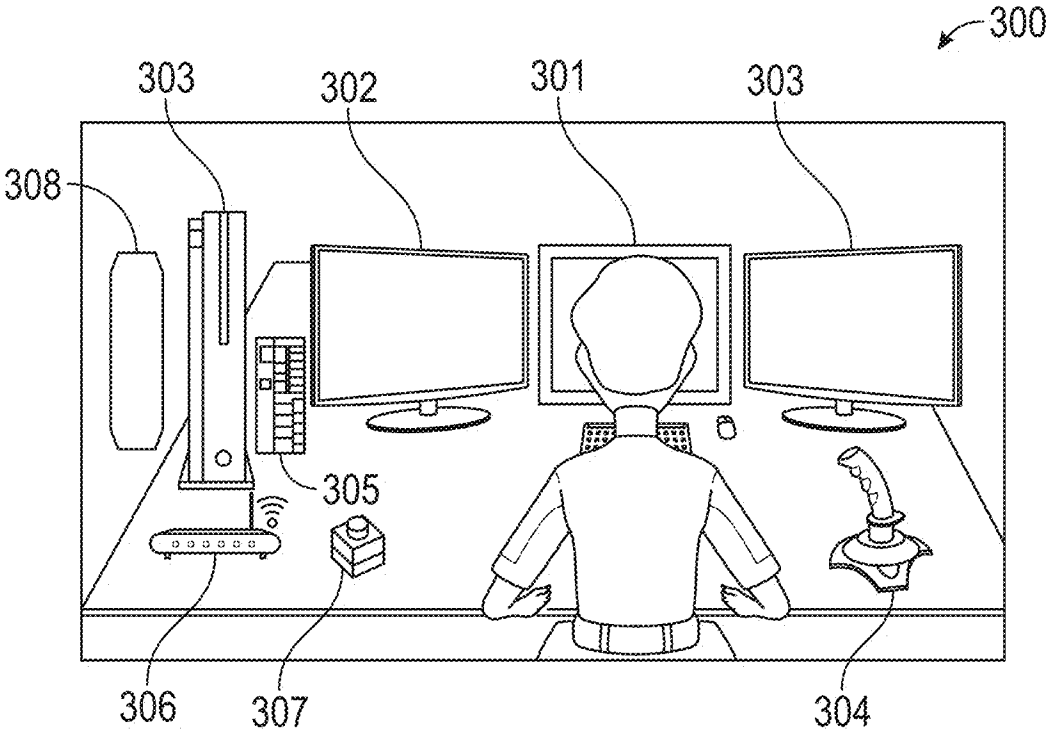
Figure 3:
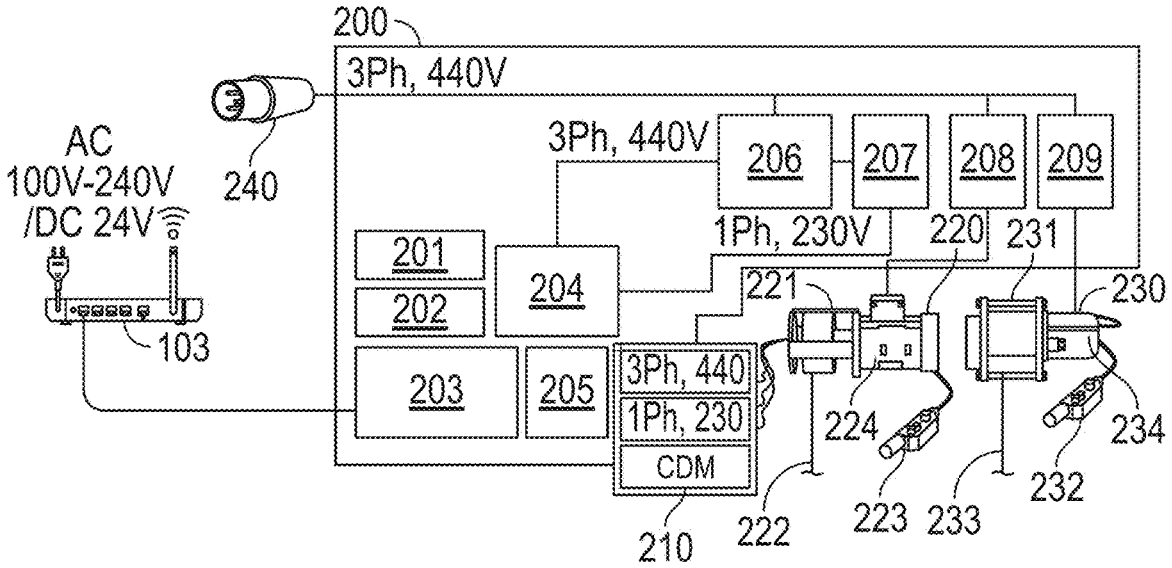
FIG. 3 is a schematic view of an exemplary power distribution unit, umbilical spooler, and steel rope spooler.
Figure 4:
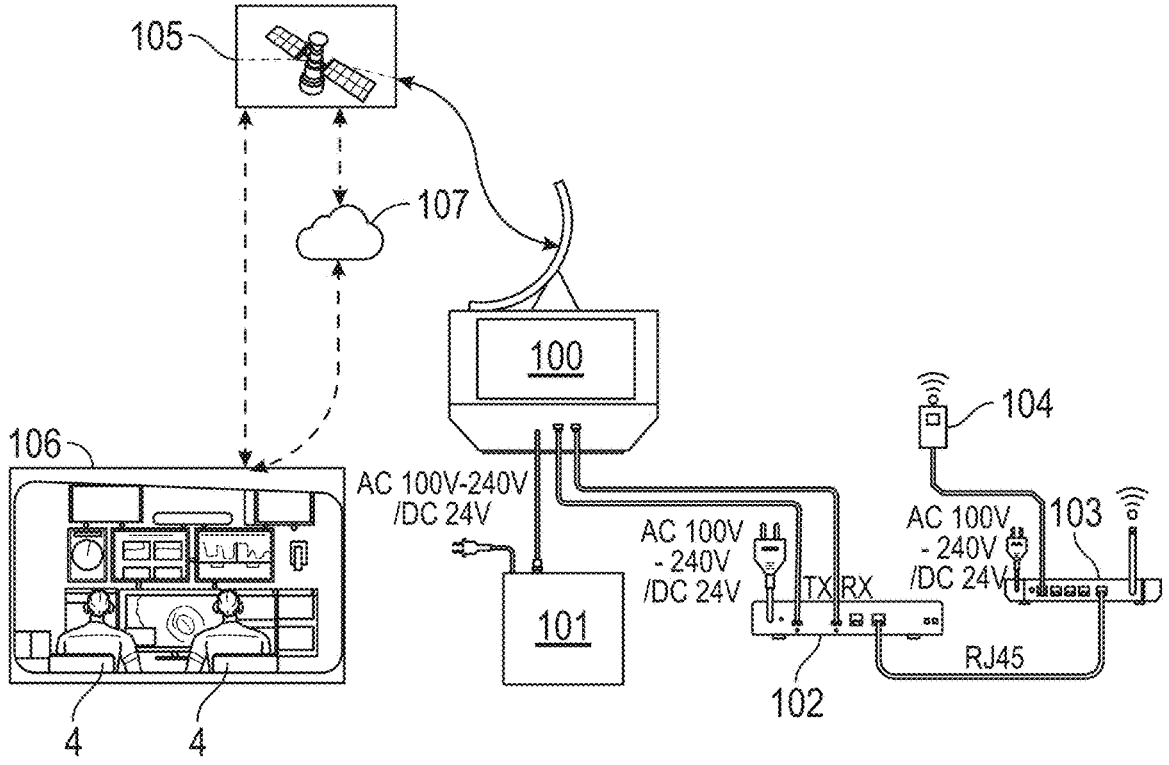
FIG. 4 is a schematic view of an exemplary data communications embodiment.

Referring additionally to FIG. 2 and FIG. 3, in most embodiments, station 300 typically comprises one or more power distribution units 200 (FIG. 3); umbilical spooler 220 (FIG. 3); and one or more rope spoolers 230 (FIG. 3). Station 300 may be connected to the outer world via internet through data communicator 100 (FIG. 4) that facilitates satellite communication 105 (FIG. 4) and is powered by uninterrupted power supply 207 (FIG. 3) using adapter 101 (FIG. 4).

Referring to FIG. 3, umbilical spooler 220 typically comprises one or more umbilicals 222 operatively in communication with power distribution unit 200, each umbilical 222 typically comprising one or more electric power conductors and one or more data conductors. These conductors may be of a sufficient length and capacity to functionally extend from station 300 (FIG. 2) to submersible robot 400 (FIG. 1). Umbilical 222 can allow for remote control of components of splash zone inspection robot system 1 and for marine structure data acquisition and real-time analytics from onshore. Umbilical spooler 220 also typically comprises one or more umbilical motors 224 and umbilical spooler 221 operatively connected to umbilical motor 224, usually one each for each umbilical 222, where each umbilical spooler 221 is configured to receive umbilical 222.

Each rope spooler 230 typically comprises steel rope spool 231 and steel rope 233 which is operatively connected to steel rope spool 231, to submersible saddle 350 (FIG. 1)

such as via steel rope connector 235 which may comprise a hook, and to crane/winch 212 (FIG. 1). One or more rope spool motors 234 are operatively connected to steel rope spool 231.

Referring now generally to FIG. 2, station 300 can comprise a pilot station, a control van, or a portable wireless console, or the like, each typically comprising the same functionality and comprising the same or an equivalent set of components, e.g., data communicator 100 (FIG. 4) operatively in communication with remote data transceiver 105 (FIG. 4), uninterrupted power supply 207 (FIG. 3) operatively in communication with various electrical components in station 300, adapter 101 (FIG. 4) operatively in communication with data communicator 100 and uninterrupted power supply 207, router 104 (FIG. 4), modem 102 (FIG. 4) operatively in communication with data communicator 100, and Wi-Fi router 103 (FIG. 4) operatively in communication with modem 102 and router 104. Modems 102 can be VSAT modems such as very-small-aperture terminal VSAT modems.

In embodiments, station 300 further comprises one or more servers 303 operatively in communication with data communicator 100 (FIG. 4); one or more programmable controller and/or programmable logic controller (PC/PLC) extension input/output (I/O) 305; one or more human-machine interfaces (HMI) 301, such as a user interface or dashboard that connects a person to a machine, system, or device, where HMI 301 is operatively in communication with server 303, one or more joysticks 304 operatively in communication with server 303, one or more camera monitors 302 operatively in communication with server 303, and one or more emergency push buttons 307 operatively in communication with Wi-Fi router 103 (FIG. 4).

In typical embodiments, server 303 is responsible to run web services that enable remote access and PC/PLC extension I/O 305 is responsible for the execution of the overall control logics. Typically, server 303 and/or PC/PLC extension I/O 305 are in communication with Wi-Fi router 103 (FIG. 1) via an ethernet cable or Wi-Fi extender 306. In some embodiments, server 303 is wirelessly in communication with PC/PLC extension I/O 305. Operator 4 (FIG. 2) can interact with splash zone inspection robot system 1 through HMI 301, joystick 304, push buttons 307, or the like, or a combination thereof. Additionally, operator 4 can interact with splash zone inspection robot system 1 from remote location 106 (FIG. 4) through dedicated web services incorporated in server 303, via cloud services 107 (FIG. 4), or the like, or a combination thereof.

In embodiments, joystick 304 may be used to jog individual axes of submersible robot 400 (FIG. 1). In certain embodiments, joystick 304 additionally has toggle buttons and push buttons to select operation modes, e.g., navigation, climb up/down, clean, align, inspect, or the like, or a combination thereof. All input devices are typically connected to PC/PLC extension I/O 305 such as via ethernet, serial communication, or extension I/O modules.

Server 303 may be connected to Wi-Fi router 103 through any appropriate communication pathway, e.g., ethernet cable, Wi-Fi, Bluetooth®, or the like, or a combination thereof. In most embodiments, heartbeat messages can be used to ensure continuous connectivity between PC/PLC extension I/O 305 and server 303. If there is no ethernet cable connection between server 303 or PC/PLC extension I/O 305 and Wi-Fi router 103 (FIG. 4), Wi-Fi extender 306 may be used to ensure connectivity.

Referring back to FIG. 1, submersible saddle 350 is typically configured to transport submersible robot 400 when submersible robot 400 is not actively in use, i.e., when submersible robot 400 is not moving independently in the water or traversing submersible saddle 350 or structure 2. In addition, submersible saddle 350, when located below a splash zone, may be used as a launch-pad for submersible robot 400.

Figure 6:
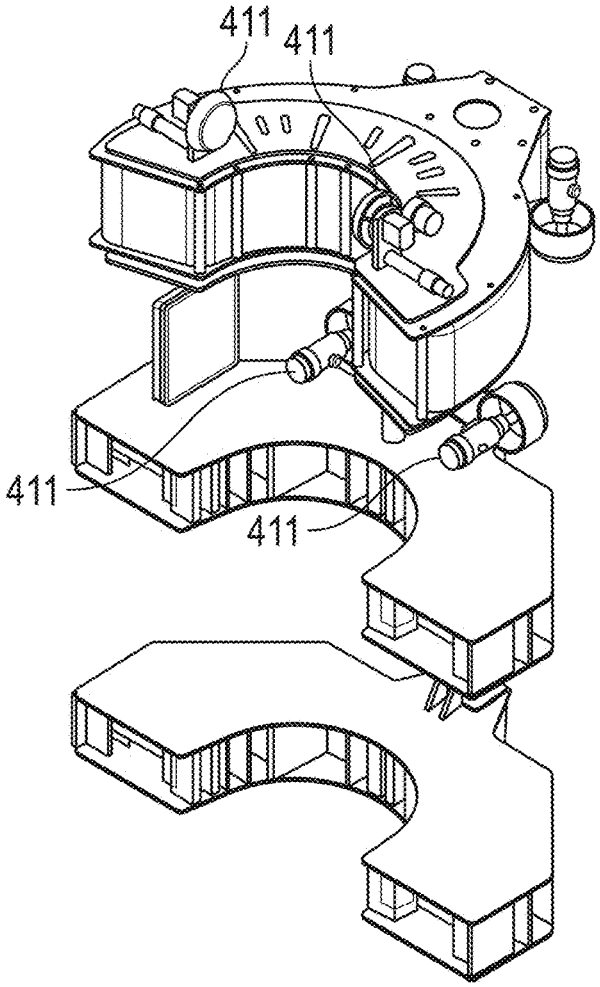
FIG. 6 is a view in partial perspective of an exploded general arrangement of an exemplary submersible robot.

Submersible robot 400 typically comprises a predetermined set of thrusters 411 (FIG. 6); at least one buoyancy tank 410 configured to provide neutral weight to submersible robot 400 when submersible robot 400 is under water; at least two controllable clamps 470,480 separated at a controllable distance along a predetermined axis of submersible robot 400 and adapted to selectively clamp submersible robot 400 to submersible saddle 350 and, separately, to selectively clamp submersible robot 400 to structure 2; clamp actuator 420 operatively in communication with the predetermined set of controllable clamps 470,480; payload carrier 440,460 configured to accept payload 490; payload carrier actuator 450; and a predetermined set of tool aligners 453 (not shown in the figures).

In embodiments, payload carrier actuator 450 comprises vertically movable cantilever 451, which can be U-shaped, operatively in communication with payload carrier 440,460 and movable along a predetermined payload axis 459 where vertically movable cantilever 451 defines a set of independent rotary axes 458 about which payload carrier 440,460 may move around, e.g., to orient one or more inspection tools and/or cleaner tools for 360° coverage around structure 2 under inspection; and payload carrier motor 430 operative to move vertically movable cantilever 451 along with payload carrier 440,460 along the predetermined payload axis without using a rectilinear motion of controllable clamps 470,480.

In embodiments, submersible robot 400 further comprises a position/orientation module configured to measure a position and an orientation of submersible robot 400 with respect to structure 2 and/or submersible saddle 350. Typically, the position/orientation module comprises an inertial measurement system (IMU); a heading sensor; a depth sensor; an acoustic locator/beacon; a wheel encoder; distance/proximity sensor, or the like, or a combination thereof.

Figure 7:
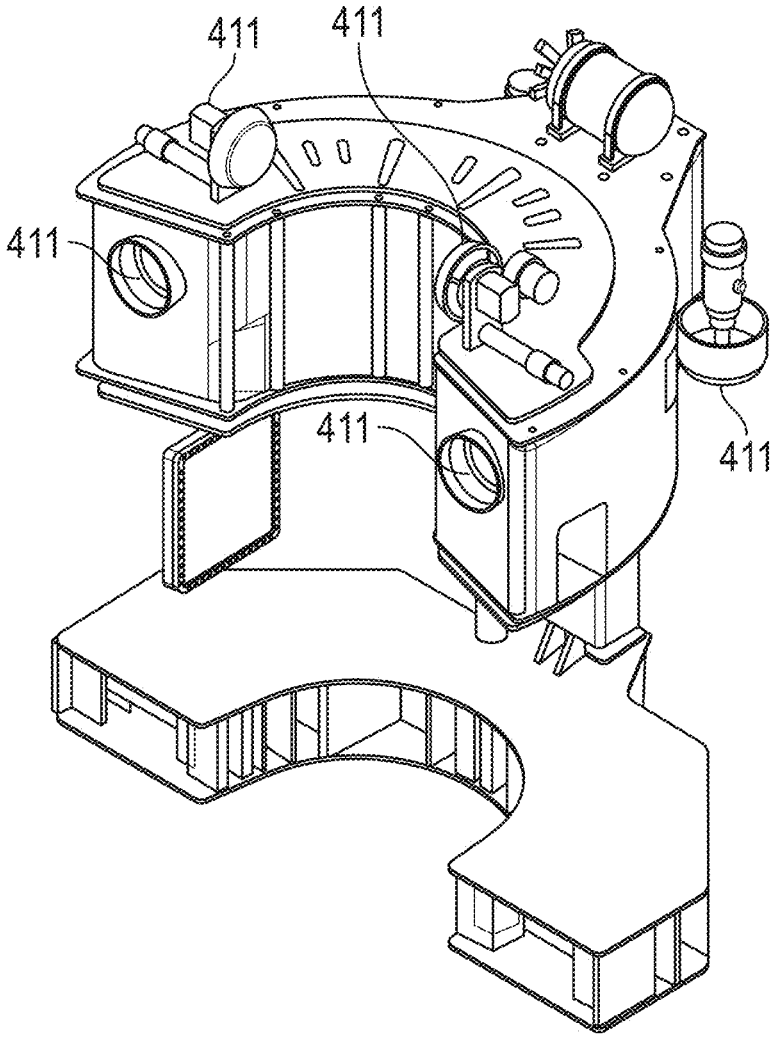
FIG. 7 is a view in partial perspective of an exploded general arrangement of an exemplary submersible robot.
Figure 8A:
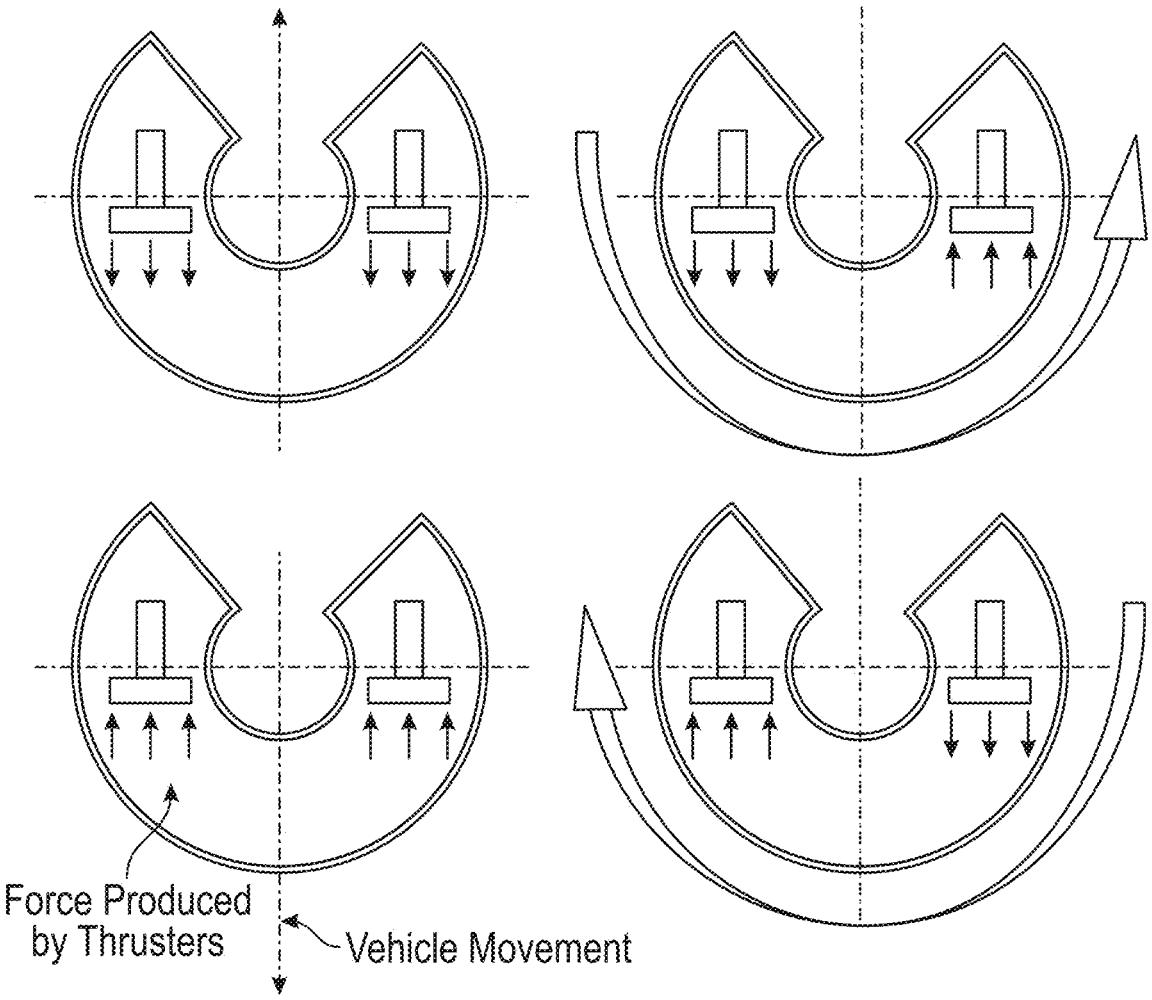
FIGS. 8A and 8B are top down views in partial perspective of an exemplary submersible robot illustrating its thrusters and movement vectors.
Figure 8B:
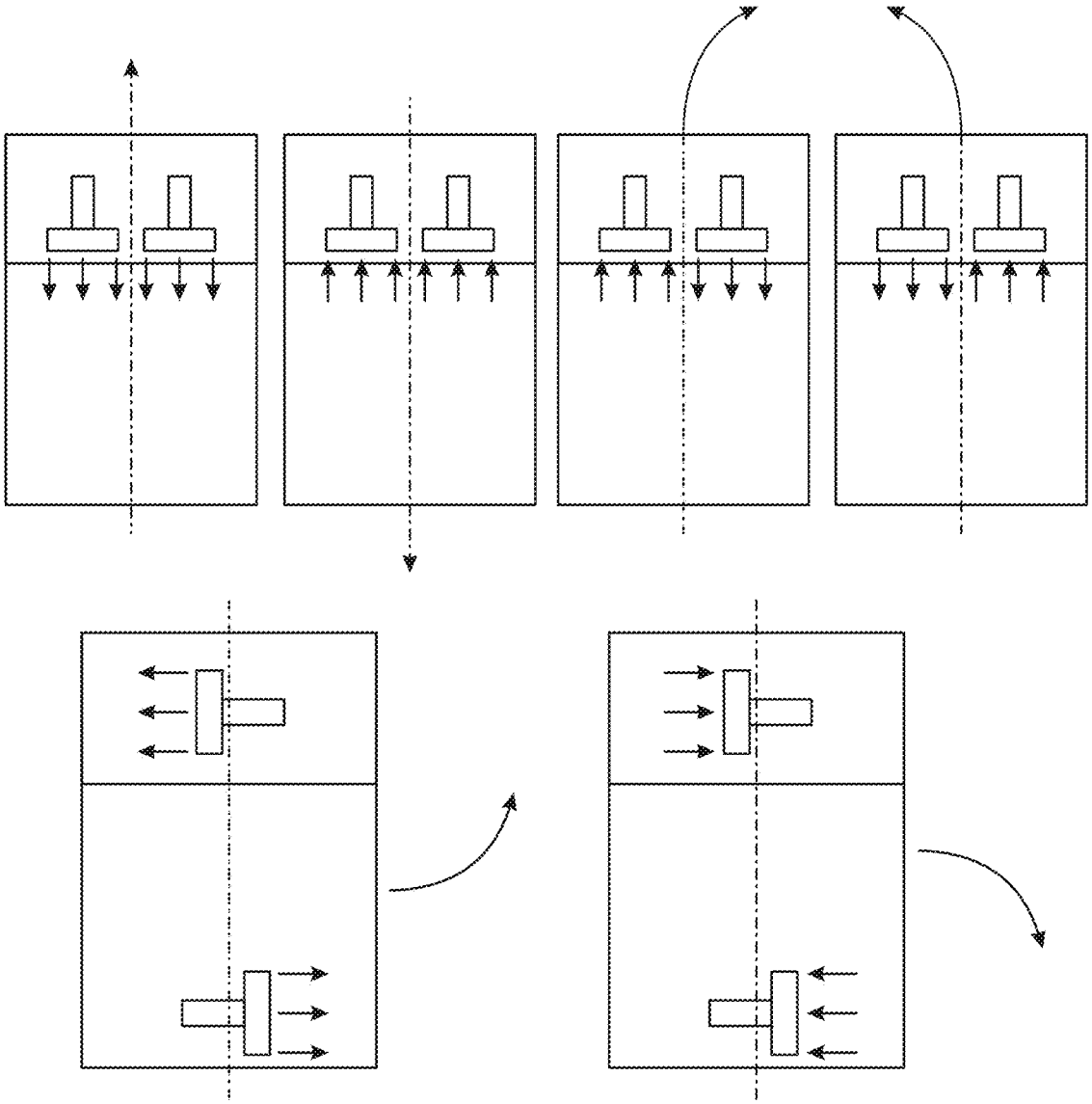

Referring generally to FIGS. 6-8B, the predetermined set of thrusters 411 (FIG. 6) may be configured to only be activated under water if submersible robot 400 is not in a clamped state and to provide six degrees of freedom movement of submersible robot 400 when it is underwater until it gets clamped to submersible saddle 350 or structure 2. In certain embodiments, the predetermined set of thrusters 411 comprises a predetermined set of inbuilt thrusters 411 (FIG. 7). In certain embodiments, the predetermined set of thrusters 411 comprises a first subset of thrusters 411, e.g. two or three, comprising selectively horizontally aligned thrusters 411 configured to provide movement of submersible robot 400 in a horizontal direction with respect to a subwater surface, e.g., a sea floor, and control speed, pitch, and yaw of submersible robot 400, and a second subset of thrusters 411, e.g. two or three, comprising selectively vertically aligned thrusters 411 configured to provide movement of submersible robot 400 in a vertical direction with respect to the subwater surface. In embodiments, the first subset of thrusters 411 is arranged in pairs and further adapted to control lateral/crab motion of submersible robot 400. In embodiments, the second subset of thrusters 411 is configured to control lift and roll of submersible robot 400 while it navigates under water.

Referring back to FIG. 1, typically, buoyancy tank 410 comprises a fixed variable buoyancy tank, a variable buoyancy tank, or the like, or a combination thereof. Buoyancy tank 410 can help provide automatic stabilization and six degrees of freedom movement when submersible robot 400 is under water.

Typically, either one or both of the two controllable clamps 470,480 are configured to support the system's weight, as measured on air as opposed to underwater, and at least one controllable clamp 470,480 of the two controllable clamps 470,480 is selectively releasable from submersible saddle 350 or the structure 2 while the other controllable clamp 470,480 is still clamped to submersible saddle 350 or structure 2. In addition, controllable clamps 470,480 may comprise a plurality of controllable clamps 470,480 arranged in pairs at a controllable distance between pairs of controllable clamps 470,480 along a predetermined axis, e.g., an axis generally coextensive with an axis defined by a longitudinal axis of structure 2 or submersible saddle 350, where controllable clamps 470,480 are adapted to selectively clamp submersible robot 400 to submersible saddle 350 and to selectively clamp submersible robot 400 to structure 2 and/or submersible saddle 350. In these embodiments, clamp actuator 420 typically comprises one clamp actuator 420 per pair of controllable clamps 470,480.

In certain embodiments, controllable clamps 470,480 comprise motorized controllable clamps adapted to hold submersible robot 400 onto submersible saddle 350 and/or structure 2, where clamp actuator 420 for motorized controllable clamps 470,480 comprises a motor. In these embodiments, motorized controllable clamps 470,480 may comprise replaceable motorized controllable clamps 470, 480.

In most embodiments, clamp actuator 420 comprises a motor, which can be a linear motor, which is responsive to provision of motion commands from control software to linear motor 420 to effect movement of linear motor 420. In these embodiments, an axis of linear motor 420 is supported mechanically by a predetermined set of guide rods.

In some embodiments, at least one controllable clamp 470,480 of the two controllable clamps 470,480 comprises a replaceable jaw configured to conform to an outer diameter of structure 2. This replaceable jaw may comprise a carry pressure pad, an electromagnet, a permanent electromagnet to hold onto structure 2, or the like, or a combination thereof. In embodiments, submersible saddle 350 further comprises a predetermined set of spacers to adapt, e.g., controllable clamps 470,480, to different jaw diameters.

Payload carrier 440,460 may further comprise one or more remotely operable subsea tools, e.g., an inspection tool which may comprise a camera, a cleaning tool, a zoom camera, a god's eye view camera, an illuminator, or the like, or a combination thereof.

Figure 5:
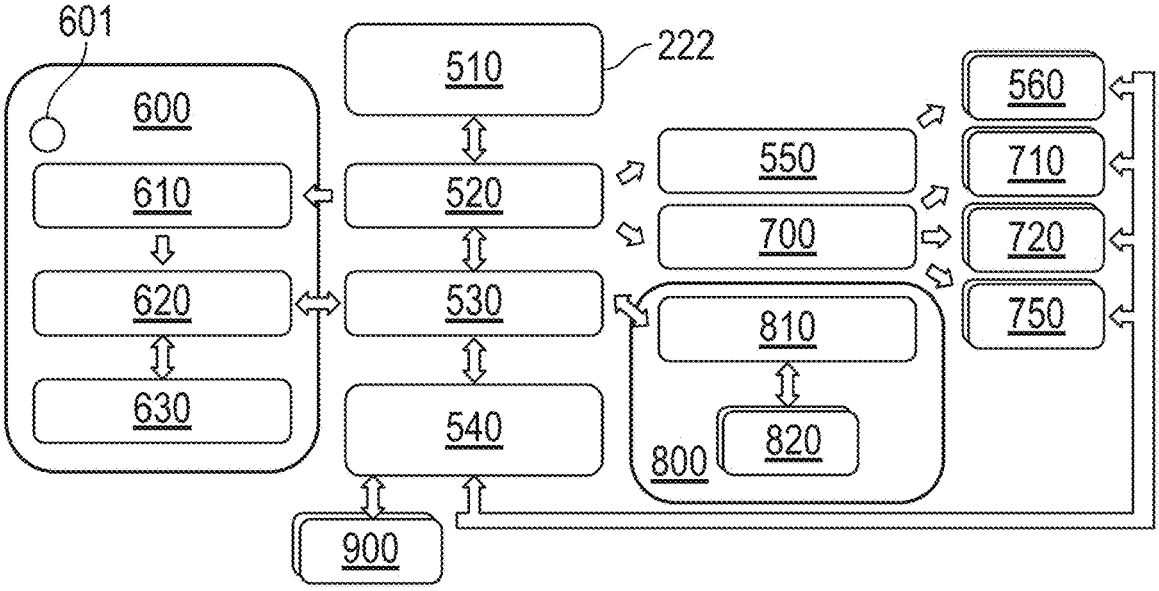
FIG. 5 is a simplified electrical block diagram of an exemplary submersible robot.

Referring to FIG. 5, S-UTA 412 (FIG. 1) may further comprise main junction box 510 adapted to receive and be operatively in communication with umbilical 222; main power bottle 520 operatively in communication with main junction box 510 and configured to receive power from the power lines of umbilical 222; main telemetry bottle 530 operatively in communication with main power bottle 520 where main telemetry bottle typically comprises a PC/PLC extension I/O disposed at least partially within main telemetry bottle 530; robot power bottle 700 operatively connected to main power bottle 520; thruster power bottle 550 operatively connected to main power bottle 520 and typically further comprising a thruster driver/controller; thruster junction box 560 operatively connected to thruster power bottle 550; cleaner junction box 710 operatively connected to robot power bottle 700; clamp junction box 720 operatively connected to robot power bottle 700; and joint junction box 750 operatively connected to robot power bottle 700. In embodiments, main power bottle 520 may further comprise one or more relays operatively connected to PC/PLC extension I/O 305. Further, each of cleaner junction box 710, clamp junction box 720, and joint junction box 750 may comprise a water entry alarm and data lines.

In embodiments, main power bottle 520 is operatively connected to main junction box 510 via a predetermined set of power lines and further comprises a predetermined set of EMI filters, contactors, AC/DC converters, temperature sensors, water alarms, or the like, or a combination thereof.

In embodiments, submersible robot 400 (FIG. 1) further comprises robot telemetry junction box 540 which is operatively in communication with main telemetry bottle 530 via main tool junction box 620; illumination and main camera junction box 810 operatively in communication with main telemetry bottle 530 via main tool junction box 620, where illumination and main camera junction box 810 is also operatively connected to, and terminates, a predetermined set of individual illumination and camera junction boxes 820; a predetermined set of joint sensors and auxiliary sensors 900 operatively connected to telemetry junction box 540; and inspection tool set 600. Inspection tool set 600 may comprises a predetermined set of inspection tools where each inspection tool of the predetermined set of inspection tools 600 is operatively connected to main power bottle 520 and main telemetry bottle 530; inspection tool power bottle 610; dedicated power supply 601 to provide power to inspection tool set 600; main tool junction box 620 operatively connected to inspection tool power bottle 610; and inspection tool junction box 630 operatively connected to main tool junction box 620. In these embodiments, the predetermined set of joint sensors and auxiliary sensors 900 may comprise a wheel encoder, an inertial measurement unit, a heading sensor, a locator and depth sensor, or the like, or a combination thereof.

In certain embodiments, referring back to FIG. 1, submersible robot 400 further comprises a position/orientation module configured to measure a position and an orientation of submersible robot 400 with respect to structure 2 and/or submersible saddle 350. The position/orientation module may comprise an inertial measurement system (IMU); a heading sensor; a depth sensor; an acoustic locator/beacon; a wheel encoder; distance/proximity sensor, or the like, or a combination thereof. If present, a distance/proximity sensor is typically configured for use for alignment of the inspection tools of inspection tool set 600. Also, if present the wheel encoder is configured to roll over structure 2 while payload carrier 440,460 is moving along structure 2 to provide data useful in determining localization of submersible robot 400 on structure 2 with respect to an initial position of submersible robot 400 on structure 2. Accordingly, a distance/proximity sensor is typically configured for use for alignment of one or more tools, e.g., inspection and/or cleaning tools, and wheel encoder adapted to roll over structure 2 while payload carrier 440,460 is moving along, e.g., up or down, over structure 2.

In embodiments, submersible robot 400 further comprises a joint actuator and a joint limit sensor. Submersible robot 400 typically effects movement in a predetermined number of degrees of freedom, where each degree of freedom comprises a predetermined set of joint variables. Typically, the joint actuator comprises an electrical motor or solenoid adapted to control the joint variables and the joint limit sensor is adapted to provide feedback useful to limit joint movement in a predetermined each of the predetermined number of degrees of freedom.

In typical embodiments, referring now to FIG. 3, power distribution unit 200 further comprises 3-phase isolation transformer 206; single-phase uninterrupted power supply 207 operatively in communication with 3-phase isolation transformer 206; protection switches 204, 208, 209 operatively in communication with 3-phase isolation transformer 206, umbilical spooler 220, and rope spooler 230; a predetermined set of EMI filters 201; DC power supply 202; media converter with managed switch 203 operatively in communication with WiFi router 103; and PC/PLC IO extension 205 operatively connected to submersible robot 400 (FIG. 1) via a flexible umbilical. Managed switch 203 may get internet connectivity via WiFi router 103 as well as distribute 3 phase AC electric power and an additional uninterrupted single phase AC power to powers electronics of submersible robot 400.

In embodiments, power distribution unit 200 drives umbilical spool 221 through umbilical motor 224, which may be electric, which winds/unwinds umbilical 222 based on its slackness measure. Alternatively, pendant 223 may be used to operate electric motor 224 manually.

Power distribution unit 200 may also drive steel rope spool 231 through electric motor 234 which may be connected to pendant 232 to operate electric motor 234 manually.

Winch 212 (FIG. 1) may further comprise topside umbilical termination assembly T-UTA 210 (FIG. 3) operatively connected to umbilical 222. Typically, T-UTA 210 is operatively connected to umbilical 222 where 3-Phase AC power, UPS power and communication lines from managed switch 203 enter umbilical 222.

In the operation of exemplary embodiments, referring back to FIG. 1, zone inspection may be accomplished using splash zone inspection robot system 1 as described above. Typically, submersible robot 400 is deployed along with submersible saddle 350 into water. Submersible robot 400 is typically clamped onto submersible saddle 350 prior to deployment. Deployment may comprise attaching submersible saddle 350 and its clamped submersible robot 400 to umbilical 222 and steel rope 233; deploying umbilical 222 and steel rope 233 through winch 212 by using umbilical spool motor 220 to unwind umbilical 222 during system deployment and using rope spool motor 230 to unwind steel rope 233 during system deployment; and, after a desired depth below a splash zone is reached, stopping the unwinding of steel rope 233 and umbilical 222. Winding and unwinding of umbilical 222 may be controlled automatically by measuring umbilical tension and automatically controlling the umbilical tension to achieve a predetermined slackness in umbilical 222. This may allow free movement of unclamped submersible robot 400 towards structure 2. The umbilical tension may be automatically controlled to achieve slackness in umbilical 222.

Submersible robot 400 and submersible saddle 350 are allowed to descend into the water to a predetermined depth below a splash zone. After that depth is reached, submersible robot 400 is unclamped from submersible saddle 350 and, after submersible robot 400 is unclamped, thrusters 411 (FIGS. 6-8B) are started under a predetermined mode of operation to get submersible robot 400 underway. In certain embodiments, as soon as submersible robot 400 gets unclamped, thrusters 411 start operating under auto pilot mode.

While underway in the predetermined mode of operation, buoyancy tank 410 may be used to adjust a buoyancy of submersible robot 400 to achieve neutrality and to help stabilize submersible robot 400 to maintain submersible robot 400 at a desired position and orientation, e.g., against sea current and other disturbances. This allows operator 4 to move submersible robot 400 underwater with less effort.

When clamped to either structure 2 or submersible saddle 350, submersible robot 400 may be moved along or about a linear axis defined by structure 2 or by submersible saddle 350 by intermittent rectilinear motion which may be achieved by clamping submersible robot 400 onto structure 2 or submersible saddle 350 using two controllable clamps 470,480; supporting an entire weight of splash zone inspection robot system 1 by first controllable clamp 480 of the two controllable clamps 470,480, where the weight is as determined in dry air; releasing second controllable clamp 470 from structure 2 or submersible saddle 350 while first controllable clamp 480 secures submersible robot 400 to structure 2 or submersible saddle 350; moving second controllable clamp 470 along structure 2 or submersible saddle 350; and then reclamping second controllable clamp 470 to structure 2 or submersible saddle 350. This may be repeated to incrementally move submersible robot 400 along structure 2 or submersible saddle 350.

Submersible robot 400 may then be used to perform a predetermined function on structure 2. After submersible robot 400 is unclamped and stabilized, operator 4 (FIG. 2) may be allowed to give a motion command to submersible robot 400 to direct submersible robot 400 to a position proximate structure 2 below the splash zone by causing submersible robot 400 to move in one or more of six degrees of freedom of movement. Submersible robot 400 may then be clamped onto structure 2 with either one or both of controllable clamps 470,480 and, once clamped to structure 2, submersible robot 400 allowed to perform the predetermined function on structure 2.

If the predetermined function comprises cleaning, submersible robot 400 can do a cleaning operation with both controllable clamps 470,480 holding onto structure 2 as well as with just one controllable clamp, e.g., 480, holding onto structure 2. This allows cleaning of an area on structure 2 for one controllable clamp 470 to engage while the other controllable clamp 480 holds onto structure 2. One controllable clamp 470,480 is typically initially clamped by operator 4 to an area of structure 2 which is free of marine growths.

If the predetermined function comprises inspection of an area using an inspection tool as described above, after completing the inspection of the area, the inspection tool and/or a zoom camera may be moved to its home position and a command may then be issued to move submersible robot 400 to a new inspection area.

After completing inspection of all desired inspection areas on structure 2, recovery action of submersible robot may be accomplished by moving submersible robot 400 back to its initial position; allowing operator 4 to release controllable clamps 470,480; enabling and using thrusters 411 (FIGS. 6-8B) to move submersible robot 400 away from structure 2; allowing submersible robot 400 to stabilize itself underwater; and allowing operator 4 to use the six degree of freedom movement of submersible robot 400 to navigate submersible robot 400 through water to another structure or to submersible saddle 350.

Additionally, first controllable clamp 480 of two controllable clamps 470,480 may be used to clamp submersible robot 400 at an initial position proximate an area of structure 2 which is free of marine growth and a wheel encoder used to obtain a reading at the initial position. The reading may be saved to a persistent data storage as an initial position of submersible robot 400. Saved data may be reloaded for other inspection areas. Then, a distance between first controllable clamp 480 and second controllable clamp 470 of two controllable clamps 470,480 may be adjusted to allow submersible robot 400 to perform a predetermined function at an area intermediate first controllable clamp 480 and second controllable clamp 470. This can include allowing the operator to move the inspection tool and/or a zoom camera closer to structure 2 such as by jogging the rotary axes or by automated scanning and align and/or focus the inspection tool and/or zoom camera towards an area of inspection.

After performing the predetermined function, operator 4 may be allowed to give a command to have submersible robot 400 traverse structure 2 or otherwise climb along structure 2 to an inspection area using rectilinear motion accomplished by allowing operator 4 to give a command to release first controllable clamp 480 of two controllable clamps 470,480; moving the released first controllable clamp 480 to a first new position along structure 2; allowing operator 4 to give a further command to first controllable clamp 480 of two controllable clamps 470,480 to secure submersible robot 400 to structure 2 at the first new position; allowing the operator to give a further command to release second controllable clamp 470 of two controllable clamps 470,480; moving the released second controllable clamp 470 to a second new position along structure 2; and allowing operator 4 to give a further command to second controllable clamp 470 of two controllable clamps 470,480 to secure submersible robot 400 to structure 2 at the second new position. After both controllable clamps 470,480 are clamped on to structure 2 at the respective first and second new positions, both controllable clamps 470,480 then secure submersible robot 400 to structure 2. In certain embodiments, submersible robot 400 may clean marine growth on structure 2 while traversing/climbing.

At any time, data communication between splash zone inspection robot system 1 and remote location 106 (FIG. 4) may be established using data communications equipment as described above.

Typically, both power and communication lines are provided via a PC/PLC from station 200 to submersible robot 400 via the same umbilical, e.g., umbilical 222.

In addition, a predetermined set of buoyancy modules (not shown in the figures but readily understood by those skilled in subsea umbilical arts without the need for illustration) may be attached to umbilical 222 to achieve neutral weight of umbilical 222 under water.

If clamp actuator 420 comprises a linear motor defining a linear motor axis supported mechanically by guide rods, where the linear motor is responsive to control software executing motion commands on or issued to the linear motor, a distance between two controllable clamps 470,480 may be controlled through software by executing or providing motion commands on or to the linear motor.

Where payload carrier 446,460 comprises an inspection tool and a radial distance controller to control a distance of the inspection tool from structure 2, operator 4 may be allowed to enable rotary axes and a payload aligner for further operation, move the inspection tool closer to structure 2, and align the inspection tool towards an area of inspection. Joint variables may be saved to help achieve this position. Operator 4 may also be allowed to move the inspection tool about structure 2 by jogging the rotary axes or by automated scanning. In addition, configuration and scan paths for automatic scan may be programmed into splash zone inspection robot system 1, and, under automated scanning, the inspection tool moved at a constant velocity about structure 2 with periodic triggering of inspection data capture.

After completing inspection of, or other predetermined functions for, all the planned areas on structure 2, a recovery action is typically initiated. During the recovery action, submersible robot 400 typically traverses/climbs back to its initial position. Operator 4 then releases both controllable clamps 470,480, triggering thrusters 411 (FIGS. 6-8B) and, in embodiments, an autopilot. Submersible robot 400 may then move away from structure 2, e.g., to a distance sufficient to avoid collision, and allowed to stabilize itself underwater. Operator 4 may then use one or more of six degree of freedom movement of submersible robot 400 to navigate it through water to another structure 2 or submersible saddle 350.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A splash zone inspection robot system, comprising:

a. a submersible saddle, comprising a steel rope connector;

b. a submersible robot comprising:

i. a predetermined set of thrusters;

ii. a buoyancy tank configured to provide neutral weight to the submersible robot when the submersible robot is under water;

iii. two controllable clamps separated at a distance along a predetermined axis of the submersible robot and adapted to selectively clamp the submersible robot to the submersible saddle and to separately selectively clamp the submersible robot to a structure;

iv. a clamp actuator operatively in communication with the predetermined set of controllable clamps;

v. a payload carrier configured to accept a payload;

vi. a payload carrier actuator, comprising;

1. a vertically movable cantilever operatively in communication with the payload carrier and movable along a predetermined payload axis (459), the vertically movable cantilever defining a set of independent rotary axes about which the payload carrier may move; and 2. a payload carrier motor operative to move the vertically movable cantilever along with the payload carrier along the predetermined payload axis without using a rectilinear motion of the controllable clamps;

vii. a predetermined set of tool aligners; and viii. a subsea umbilical termination assembly (S-UTA) configured to connect to and terminate an umbilical and to operatively connected to a crane/winch; and c. a subsea robot controller operatively in communication with the submersible robot.

2. The splash zone inspection robot system of claim 1, wherein the submersible saddle is configured to transport the submersible robot when the submersible robot is not actively in use.

3. The splash zone inspection robot system of claim 1, wherein the predetermined set of thrusters are configured:

a. to only be activated under water if the submersible robot is not in a clamped state; and b. to provide movement of the submersible robot underwater with six (6) degrees of freedom until the submersible robot gets clamped to the submersible saddle or the structure.

4. The splash zone inspection robot system of claim 1, wherein the predetermined set of thrusters comprises:

a. a first subset of thrusters comprising horizontally aligned thrusters configured to provide movement of the submersible robot in a horizontal direction and control speed, pitch, and yaw of the submersible robot; and b. a second subset of thrusters comprising vertically aligned thrusters configured to provide movement of the submersible robot in a vertical direction.

5. The splash zone inspection robot system of claim 1, wherein:

a. either one or both of the two controllable clamps are configured to support the weight of the splash zone inspection robot system on air; and b. at least one controllable clamp of the two controllable clamps is selectively releasable from the submersible saddle or the structure while the other controllable clamp is clamped to the submersible saddle or the structure.

6. The splash zone inspection robot system of claim 1, wherein the controllable clamps comprise motorized controllable clamps adapted to hold the submersible robot onto the structure, the motorized controllable clamps comprising a motor.

7. The splash zone inspection robot system of claim 1, wherein the payload carrier further comprises a remotely operable subsea tool.

8. The splash zone inspection robot system of claim 1, wherein the S-UTA further comprises:

a. a main junction box adapted to receive and be operatively in communication with the umbilical;

b. a main power bottle operatively in communication with the main junction box, the main power bottle configured to receive power from power lines of the umbilical;

c. a main telemetry bottle operatively in communication with the main power bottle;

d. a robot power bottle operatively connected to the main power bottle;

e. a thruster power bottle operatively connected to the main power bottle and comprising a thruster driver/controller;

f. a thruster junction box operatively connected to the thruster power bottle;

g. a cleaner junction box operatively connected to the submersible robot power bottle;

h. a clamp junction box operatively connected to the submersible robot power bottle; and i. a joint junction box operatively connected to the submersible robot power bottle.

9. The splash zone inspection robot system of claim 8, wherein:

a. the main power bottle is operatively connected to the main junction box via a predetermined set of power lines; and b. the main power bottle further comprises a predetermined set of EMI filters, contactors, AC/DC converters, temperature sensors, and water alarms.

10. A splash zone inspection robot system, comprising:

a. a station, comprising:

i. a power distribution unit;

ii. an umbilical spooler, comprising:

1. an umbilical operatively in communication with the power distribution unit and comprising an electric power conductor and a data conductor;

2. an umbilical motor; and 3. an umbilical spooler configured to receive the umbilical and operatively connected to the umbilical motor; and iii. a crane/winch operatively connected to the submersible saddle; and iv. a rope spooler, comprising:

1. a steel rope spool;

2. a steel rope operatively connected to the steel rope spool and to the crane/winch; and 3. a rope spool motor operatively connected to the steel rope spool;

b. a submersible saddle operatively connected to the steel rope;

c. a submersible robot operatively in communication with the station, its power distribution unit, and the umbilical, the submersible robot comprising:

i. a predetermined set of thrusters;

ii. a buoyancy tank configured to provide neutral weight to the submersible robot when the submersible robot is under water;

iii. two controllable clamps separated at a distance along a predetermined axis of the submersible robot and adapted to selectively clamp the submersible robot to the submersible saddle and to separately selectively clamp the submersible robot to a structure;

iv. a clamp actuator operatively in communication with the predetermined set of controllable clamps;

v. a payload carrier configured to accept a payload;

vi. a payload carrier actuator, comprising;

1. a vertically movable cantilever operatively in communication with the payload carrier and movable along a predetermined payload axis (549), the vertically movable cantilever defining a set of independent rotary axes about which the payload carrier may move; and 2. a payload carrier motor operative to move the vertically movable cantilever along with the payload carrier along the predetermined payload axis without using a rectilinear motion of the controllable clamps;

vii. a predetermined set of tool aligners; and viii. a subsea umbilical termination assembly (S-UTA), the umbilical operatively connected to, and configured to terminate at, the S-UTA, the S-UTA operatively connected to the crane/winch; and d. a subsea robot controller operatively in communication with the submersible robot.

11. The splash zone inspection robot system of claim 10, wherein the station comprises a pilot station, a control van, or a portable wireless console.

12. The splash zone inspection robot system of claim 10, wherein the station further comprises:

a. a data communicator operatively in communication with a remote data transceiver;

b. an uninterrupted power supply;

c. an adapter operatively in communication with the data communicator and the uninterrupted power supply;

d. a router;

e. a modem operatively in communication with the data communicator; and f. a Wi-Fi router operatively in communication with the modem and the router.

13. The splash zone inspection robot system of claim 12, wherein the uninterrupted power supply comprises a single-phase uninterrupted power supply, the splash zone inspection robot system further comprising:

a. a 3-phase isolation transformer operatively connected to the single-phase uninterrupted power supply;

b. a protection switch operatively in communication with the 3-phase isolation transformer, the umbilical spooler, and the rope spooler;

c. a predetermined set of EMI filters;

d. a DC power supply;

e. a media converter with a managed switch operatively in communication with a WiFi router; and f. a programmable controller and/or programmable logic controller (PC/PLC) input/output (IO) extension operatively connected to the submersible robot via a flexible umbilical.

* * * * *